US006085424A

United States Patent [19]

Mai

[11] Patent Number: 6,085,424

[45] Date of Patent: Jul. 11, 2000

[54] HAND TOOL HAVING A HANDLE PROVIDED WITH MEANS FOR FASTENING DETACHABLY THE HANDLE WITH A BLADE

[76] Inventor: Hsiao-Feng Mai, No. 17, Chuan Yuan Street, Taichung, Taiwan

[21] Appl. No.: 09/287,114

[22] Filed: Apr. 7, 1999

[51] Int. Cl.[7] ..... B26B 5/00

[52] U.S. Cl. ..... 30/169; 15/236.01; 30/335; 30/339; 81/436

[58] Field of Search ..... 30/169–172, 340, 30/339, 335; 15/236.01; 279/97; 7/165; 81/436; 24/460

[56] References Cited

U.S. PATENT DOCUMENTS 1,458,171 6/1923 Donaldson ..... 279/97
4,386,609 6/1983 Mongeon ..... 30/339
5,575,030 11/1996 Girard ..... 15/236.01 X

*Primary Examiner*—Douglas D. Watts
*Attorney, Agent, or Firm*—Browdy and Neimark

[57] ABSTRACT

A hand tool having a handle provided with a fastening member for fastening detachably the handle with a blade. The handle is provided with an insertion hole extending along the direction of the longitudinal axis of the handle, and a receiving slot perpendicular to the insertion hole. The insertion hole is intended to receive the fastening end of the blade. The fastening member is located in the receiving slot and composed of a spring, a retaining block and a press block. The blade is detachably fastened with the handle such that the retaining block of the fastening member is removably located in a locating hole of the fastening end of the blade, and that the retaining block can be actuated by the press block to move out of the locating hole of the blade to enable the fastening end of the blade to be pulled out of the insertion hole of the handle.

10 Claims, 4 Drawing Sheets

HAND TOOL HAVING A HANDLE PROVIDED WITH MEANS FOR FASTENING DETACHABLY THE HANDLE WITH A BLADE

FIELD OF THE INVENTION

The present invention relates generally to a handle of the hand tool, and more particularly to the handle that is compatible with the blades of various hand tools.

BACKGROUND OF THE INVENTION

The conventional hand tools are generally composed of a blade and a handle which is fastened fixedly with the blade and must be therefore discarded along with a damaged or worn-out blade. In addition, the conventional hand tools can not be easily stored or shipped in view of the fact that the blade and the handle of the conventional hand tools are not detachably fastened together.

SUMMARY OF THE INVENTION

The primary objective of the present invention is therefore to provide a hand tool with a handle which is compatible with the blade of another hand tool.

It is another objective of the present invention to provide a hand tool with a handle which is detachably fastened with a blade of the handle tool so as to facilitate the storing or shipping of the hand tool.

The foregoing objectives of the present invention are attained by a hand tool comprising a blade, a handle, and a fastening member for fastening detachably the blade with the handle. The blade is provided at one end thereof with a fastening portion having a locating hole. The handle is provided at one end thereof with an insertion hole extending in the direction of a longitudinal axis of the handle for receiving the one end of the blade. The handle is further provided at the one end thereof with a receiving slot perpendicular to the insertion hole for mounting therein the fastening member which is formed of a spring, a retaining block, and a press block. The blade is fastened securely with the handle such that the locating hole of the fastening portion of the blade is detachably engaged with the retaining block of the fastening member. As the press block of the fastening member is pressed, the retaining block of the fastening member is disengaged with the locating hole of the blade, thereby enabling the blade to be unfastened with the handle.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
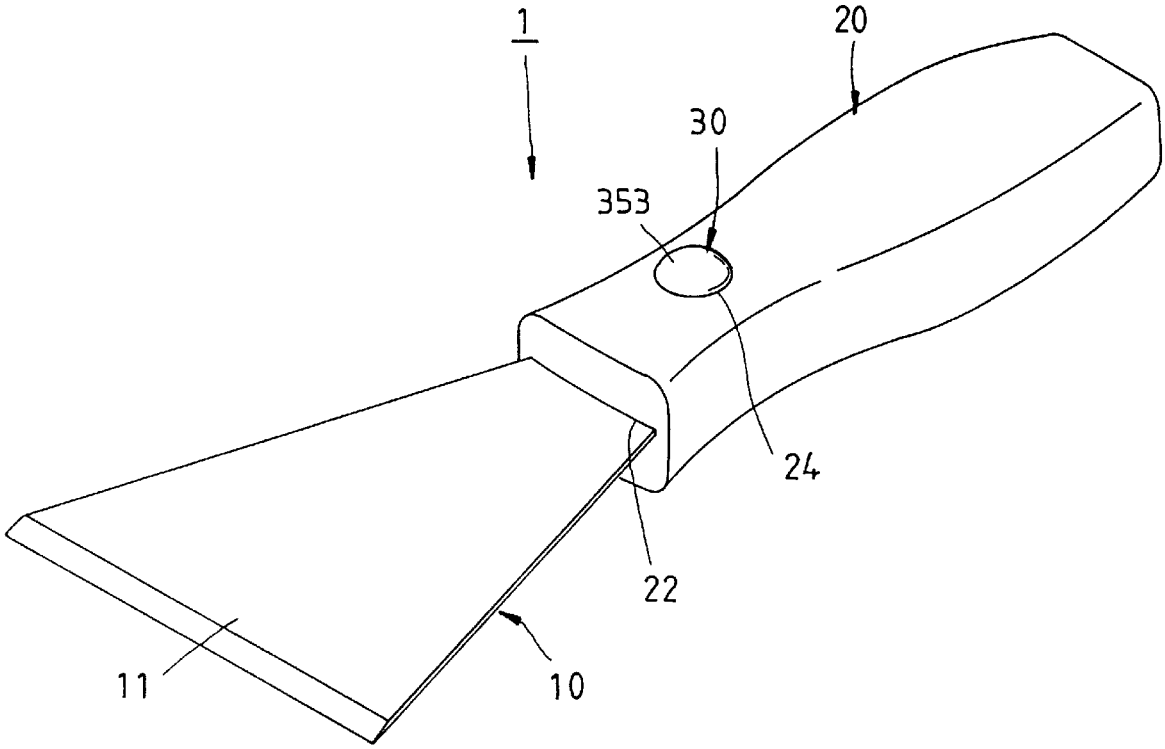
FIG. 1 shows a perspective view of the present invention.
Figure 2:
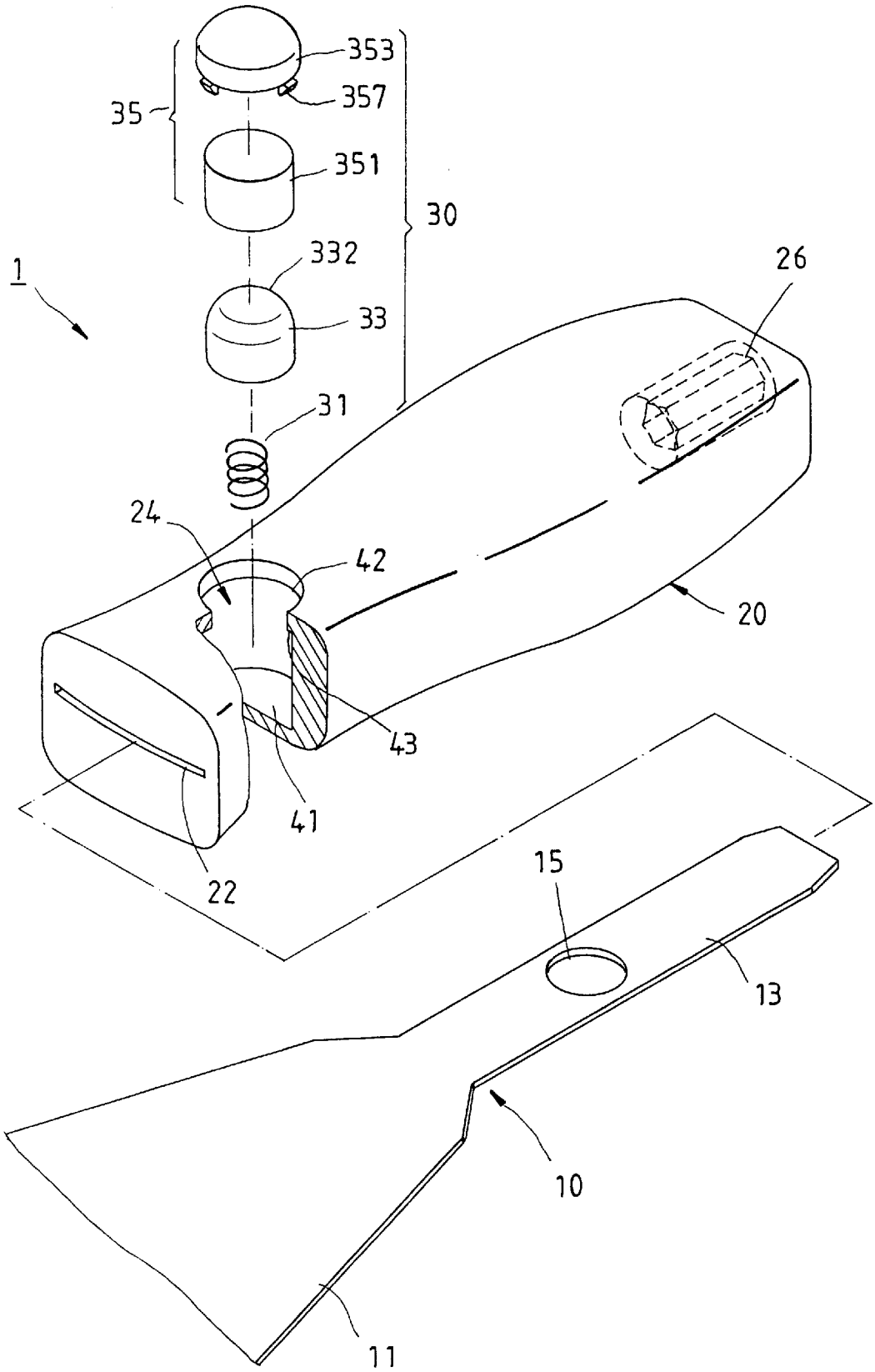
FIG. 2 shows an exploded view of the present invention.

As shown in FIGS. 1 and 2, a painter's hand tool 1 embodied in the present invention is composed of a blade

10, a handle 20, and a fastening member 30 for fastening the blade 10 with the handle 20.

The blade 10 is made of a metal material and provided at one end thereof with a working portion 11 and at other end thereof with a fastening portion 13. The working portion 11 is used to scrape the old paint coat off a surface. The fastening portion 13 is provided with a locating hole 15.

The handle 20 is provided at one end thereof with an insertion hole 22 of a length and extending along the direction of a longitudinal axis of the handle 20. The insertion hole 22 is dimensioned to accommodate the fastening portion 13. The handle 20 is further provided in the vicinity of the one end thereof with a receiving slot 24 perpendicular to the insertion hole 22. The receiving slot 24 is of a stepped construction and has a large diametrical portion 41, a small diametrical portion 42, and a shoulder 43 located between the large diametrical portion 41 and the small diametrical portion 42. The handle 20 is further provided at other end thereof with a hexagonal hole 26 which is intended to engage a hexagonal screwdriver (not shown in the drawing) for turning screws.

The fastening member 30 comprises a spring 31, a retaining block 33, and a press block 35. The fastening member 30 is disposed in the receiving slot 24 of the handle 20 such that the spring 31 is located at the bottom of the receiving slot 24, and that the retaining block 33 is in contact with one end of the spring 31, and further that the press block 35 is partially jutted out of the surface of the handle 20. The retaining block 33 is provided in the bottom thereof with a locating recess 331 for locating the one end of the spring 31. The spring 31 and the retaining block 33 are located in the large diametrical portion 41 of the receiving slot 24. The retaining block 33 is provided at the upper end thereof with an arcuate portion 332 which is intended to facilitate the engaging or the disengaging of the retaining block 33 with the locating hole 15 of the fastening portion 13 of the blade 10. The press block 35 is formed of a lower portion 351 and an upper portion 353 which is provided in the bottom thereof with a recess 355, and in the periphery of the bottom thereof with a plurality of claws 357. The lower portion 351 is in contact with the retaining block 33 such that the upper end of the lower portion 351 is fitted into the recess 355 of the upper portion 33. As the upper portion 353 is pressed with finger, the claws 357 are forced to move inwards so as to pass through the small diametrical portion 42 to rest against the shoulder 43.

Figure 3:
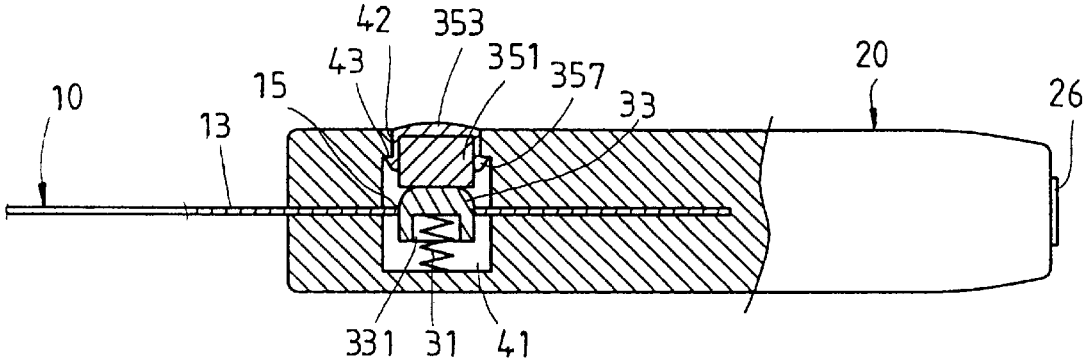
FIG. 3 shows a sectional view taken along the direction indicated by a line 3—3 as shown in FIG. 2.
Figure 4:
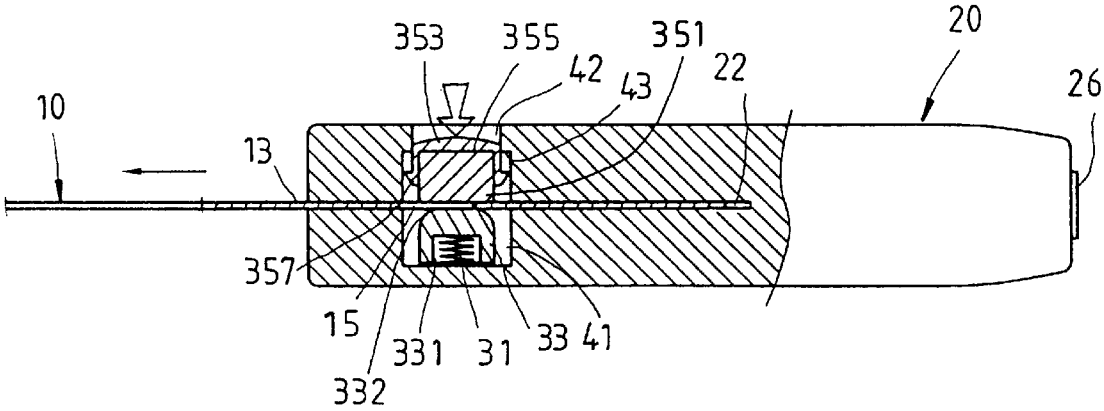
FIG. 4 is a schematic view showing that the blade of a painter's hand tool of the present invention is being unfastened with the handle.

As shown in FIG. 3, when the press block 35 is pressed with finger, the lower portion 351 of the press block 35 pushes the retaining block 33 to compress the spring 31 so as to enable the retaining block 33 to move out of the locating hole 15 of the blade 10. As shown in FIG. 4, the fastening portion 13 of the blade 10 can be thus pulled in the direction indicated by an arrow, so as to become detached with the handle 20. The blade 10 can be rejoined with the handle 20 by first pressing the press block 35 to cause the retaining block 33 to move downward before the fastening portion 13 of the blade 10 is inserted into the insertion hole 22 of the handle 20. The fastening portion 13 can not be obstructed by the retaining block 33 in light of the arcuate portion 332 of the retaining block 33. As the fastening portion 13 is pushed to pass the arcuate portion 332 of the retaining block 33, both the retaining block 33 and the spring 31 are pressed by the fastening portion 13 of the blade 10 until the locating hole 15 of the fastening portion 13 is located in the receiving slot 24. In the meantime, the retaining block 33 and the spring 31 are relieved of the pressure exerting thereon, so as to move back up such that the retaining block 33 is caught in the locating hole 15 of the fastening portion 13 of the blade 10.

Figure 5:
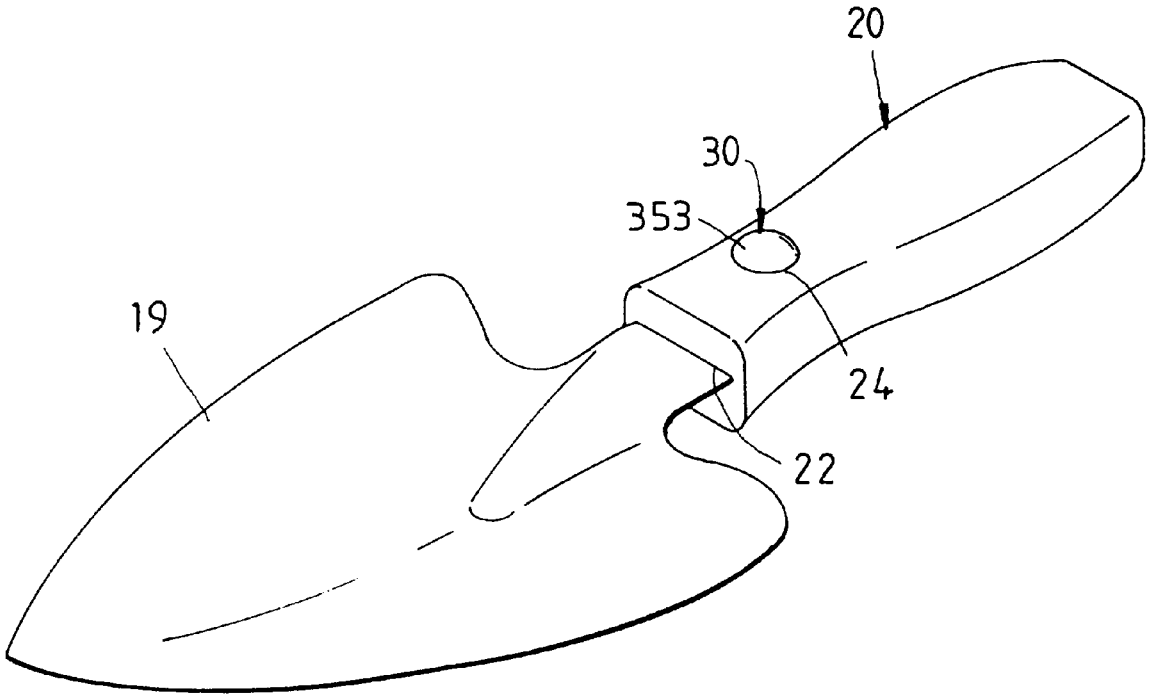
FIG. 5 is a schematic view showing that the handle of the painter's hand tool of the present invention is fastened with a blade of the gardener's hand tool.

It is therefore readily apparent that the blade 10 and the handle 20 can be fastened or unfastened with ease and speed, thanks to the fastening member 30. As a result, the handle 20 of the painter's hand tool of the present invention can be used to fasten with a blade 19 of a gardener's hand tool, as shown in FIG. 5.

What is claimed is:

1. A hand tool comprising a handle and a blade detachably engaged at a fastening end thereof with one end of said handle; wherein said handle is provided at said one end thereof with an insertion hole having a length extending along the direction of a longitudinal axis of said handle for receiving the fastening end of said blade, the fastening end having a locating hole with a 360° circumference, said handle further provided in the vicinity of said one end thereof with a receiving slot perpendicular to said insertion hole, and a means for detachably engaging the locating hole in said fastening end with said handle, said means being composed of a spring biasing a retaining block against a press block, said means being located in said receiving slot such that operation of the press block against the spring disengages said retaining block from the locating hole of the fastening end of the blade and permits the blade to be pulled out of the handle between the press block and the retaining block which are separated by the blade;

wherein said receiving slot has a large diametrical portion, a small diametrical portion, and a shoulder located between said large diametrical portion and said small diametrical portion; wherein said spring and said retaining block of said fastening means are located in said large diametrical portion of said receiving slot; and wherein said press block of said fastening means is located in said small diametrical portion such that one end of said press block is in contact with said retaining block which is in turn in contact with said spring, said press block further provided in an outer periphery thereof with a plurality of claws engaged against said shoulder of said receiving slot.

2. A hand tool comprising a handle and a blade detachably engaged at a fastening end thereof with one end of said handle; wherein said handle is provided at said one end thereof with an insertion hole having a length extending along the direction of a longitudinal axis of said handle for receiving the fastening end of said blade, the fastening end having a locating hole with a 360° circumference, said handle further provided in the vicinity of said one end thereof with a receiving slot perpendicular to said insertion hole, and a means for detachably engaging the locating hole in said fastening end with said handle, said means being composed of a spring biasing a retaining block against a press block, said means being located in said receiving slot such that operation of the press block against the spring disengages said retaining block from the locating hole of the fastening end of the blade and permits the blade to be pulled out of the handle between the press block and the retaining block which are separated by the blade.

3. The hand tool as defined in claim 1, wherein said handle is provided at other end thereof with a hexagonal hole for locating a hexagonal screwdriver.

4. The hand tool as defined in claim 2, wherein said receiving slot has a large diametrical portion, a small diametrical portion, and a shoulder located between said large diametrical portion and said small diametrical portion; wherein said spring and said retaining block of said fastening means are located in said large diametrical portion of said receiving slot; and wherein said press block of said fastening means is located in said small diametrical portion such that one end of said press block is in contact with said retaining block which is in turn in contact with said spring, said press block further provided in an outer periphery thereof with a plurality of claws engaged against said shoulder of said receiving slot.

5. The hand tool as defined in claim 1, wherein said retaining block is provided at one end thereof with a recess for locating one end of said spring.

6. The hand tool as defined in claim 1, wherein said retaining block is provided at other end thereof with an arcuate portion to facilitate the inserting of the fastening portion of the blade into said insertion hole of said handle, and to facilitate the withdrawing of the fastening portion of the blade from said insertion hole of said handle.

7. The hand tool as defined in claim 2, wherein said handle is provided at other end thereof with a hexagonal hole for locating a hexagonal screwdriver.

8. The hand tool as defined in claim 2, wherein said receiving slot has a large diametrical portion, a small diametrical portion, and a shoulder located between said large diametrical portion and said small diametrical portion; wherein said spring and said retaining block of said fastening means are located in said large diametrical portion of said receiving slot; and wherein said press block of said fastening means is located in said small diametrical portion such that one end of said press block is in contact with said retaining block which is in turn in contact with said spring, said press block further provided in an outer periphery thereof with a plurality of claws engaged against said shoulder of said receiving slot.

9. The hand tool as defined in claim 2, wherein said retaining block is provided at one end thereof with a recess for locating one end of said spring.

10. The hand tool as defined in claim 2, wherein said retaining block is provided at other end thereof with an arcuate portion to facilitate the inserting of the fastening portion of the blade into said insertion hole of said handle, and to facilitate the withdrawing of the fastening portion of the blade form said insertion hole of said handle.

* * * * *